US005277626A

United States Patent [19]

Oikawa et al.

[11] Patent Number: 5,277,626

[45] Date of Patent: Jan. 11, 1994

[54] MECHANISM FOR ELECTRICALLY CONNECTING AND DISCONNECTING DARK CURRENT FUSES

[75] Inventors: Ryuetsu Oikawa; Akira Ikari, both of Shizuoka, Japan

[73] Assignee: Yazaki Corporation, Tokyo, Japan

[21] Appl. No.: 985,966

[22] Filed: Dec. 4, 1992

[30] Foreign Application Priority Data

Dec. 6, 1991 [JP] Japan ..... 3-323005

[51] Int. Cl.[5] ..... H01R 13/68

[52] U.S. Cl. ..... 439/621; 439/622

[58] Field of Search ..... 439/621, 622

[56] References Cited

U.S. PATENT DOCUMENTS 5,145,414 9/1992 Oikawa .

5,171,293 12/1992 Umemoto et al. ..... 439/622

FOREIGN PATENT DOCUMENTS 0145088 6/1985 .

832789 9/1955 United Kingdom .

2211678 7/1989 United Kingdom .

2218282 11/1989 United Kingdom .

*Primary Examiner*—Eugene F. Desmond

*Attorney, Agent, or Firm*—Sughrue, Mion, Zinn, Macpeak & Seas

[57] ABSTRACT

To assure that electrical connection and disconnection can be achieved without any removal of dark current fuses from a fuse holder, a mechanism for connecting them to and disconnecting them from opponent contact terminals. The mechanism includes a fuse holder having the dark current fuses received therein, a fuse block having the contact members received therein, provisional engaging mechanism serving to hold terminal tabs of each dark current fuse in the electrically disconnected state and firm engaging mechanism serving to hold the terminal tabs in the electrically connected state. The provisional engaging mechanism is constructed of provisional engagement projections on the fuse block and engagement pawls on the fuse holder. The firm engaging mechanism is constructed of firm engagement projections on the fuse block and engagement portions of engagement wall portions on the fuse holder. Alternatively, the provisional engaging mechanism may be constructed of guide projections and engagement projections on the fuse block and cutout grooves and provisional engagement projections on the fuse holder. In this case, firm engagement projections are formed at the position in the vicinity of the terminal ends of the cutout grooves.

7 Claims, 5 Drawing Sheets

MECHANISM FOR ELECTRICALLY CONNECTING AND DISCONNECTING DARK CURRENT FUSES

BACKGROUND OF THE INVENTION

1. Field of the Invention

The present invention relates generally to a mechanism for electrically connecting and disconnecting dark current fuses. More particularly, the present invention relates to a mechanism for electrically connecting and disconnecting dark current fuses employable for circuits in electrical equipment connected directly to a battery mounted in an automobile.

2. Background

To facilitate an understanding of the present invention, a typical conventional mechanism for electrically connecting and disconnecting dark current fuses, as disclosed in Japanese Utility Model Laid-Open Publication No. 62-18947, will briefly be described below with reference to FIG. 11.

Referring to FIG. 11, reference numerals 45 and 46 designate fuse insertion blocks arranged in an electrical connection box 47. As is apparent from the drawing, the fuse insertion block 45 for receiving a dark current fuse 48 extends upwardly to a greater extent than the other fuse block 46 which receives an ordinary fuse 49.

The dark current fuse 48 is practically used to maintain a dark current component, such as a clock, connected directly to a battery in the electrically OFF state until an automobile is delivered to the user after completion of production of the automobile. Usually, the dark current fuse 48 is disconnected from the fuse block in the production factory, and is reinserted in the fuse block later by a dealer before the automobile is delivered to the user. To assure that the dealer can easily insert the dark current fuse in its fuse block 45, the fuse block 45 is intentionally designed to protrude relatively high so as to enable the dark current fuse to be easily distinguished from the other ordinary fuse blocks by the dealer.

With the conventional mechanism constructed in the above-described manner, however, a problem occurs in that the dark current fuse is often lost since there is no means for retaining the dark current fuse after it has been removed from the fuse block.

SUMMARY OF THE INVENTION

The present invention has been made in consideration of the foregoing background.

An object of the present invention is to provide a mechanism for electrically connecting and disconnecting dark current fuses wherein electrical connection and disconnection can be achieved without any necessity for removing the dark current fuses from a fuse block.

Another object of the present invention is to provide a mechanism for electrically connecting and disconnecting dark current fuses wherein it is not necessary to keep track of the fuses after they have been disconnected from the fuse block.

A further object of the present invention is to provide a mechanism for electrically connecting and disconnecting dark current fuses in such a manner that they will not be lost.

According to one aspect of the present invention, there is provided a mechanism for electrically connecting and disconnecting dark current fuses, wherein said mechanism comprises a fuse holder having the dark current fuses received therein through fuse insert guide slits, each of the dark current fuses including a main body and two terminal tabs, a fuse block including contact members adapted to be engaged with the terminal tabs of the dark current fuses by displacing the terminal tabs in positional alignment with the contact members for engagement of the terminal tabs with the contact members, provisional engaging means for bringing the fuse holder in provisional engagement with the fuse block by fitting a part of the fuse holder onto the fuse block, and firm engaging means for bringing the fuse holders in firm engagement with the fuse block by fully fitting the former onto the latter.

The provisional engaging means serves to hold the terminal tabs in the electrically disconnected state relative to the contact members without any removal of the dark current fuses from the fuse holder. The provisional means is constructed of provisional engagement projections each projected inwardly of the foremost end of a provisional engagement piece on the fuse block side and engagement pawls on the fuse holder side adapted to be engaged with the provisional engagement projection.

On the other hand, the firm engaging means serves to hold the terminal tabs in the electrically connected state relative to the contact members. The firm engaging means is constructed of firm engagement projections each projected outwardly from the foremost end of a firm engagement piece on the fuse block side and engagement portions provided in the engagement wall portions on the fuse holder side adapted to be engaged with the firm engagement projections.

In addition, according to other aspect of the present invention, there is provided a mechanism for electrically connecting and disconnecting dark current fuses, wherein the mechanism comprises a fuse holder having the dark current fuses received therein through fuse insert guide slits, each of the dark current fuses including a main body and two terminal tabs, a fuse block including contact members adapted to be engaged with the terminal tabs of the dark current fuses by displacing the terminal tabs at a right angle relative to the direction of extension of the contact members, provisional engaging means for bringing the fuse holder in provisional engagement with the fuse block by fitting a part of the fuse holder onto the fuse block, and firm engaging means for bringing the fuse holder in firm engagement with the fuse block by fully fitting the former onto the latter.

The provisional engaging means is constructed of guide projections disposed on the opposite side walls of the fuse block and including engagement projections at the foremost ends of the guide projection, and cutout grooves formed on the opposite side walls of the fuse holder and including provisional projections formed on the inlet side of the cutout grooves on the fuse block side. The provisional engagement projections are respectively engaged with the engagement projections when the fuse holder is held in the provisionally engaged state by fitting a part of the fuse holder onto the fuse block.

Further, the firm engagement means is constructed of guide projections having the engagement projections at the foremost end thereof, and the cutout grooves formed in the opposite side walls of the fuse holder and including firm engagement projections respectively formed at the terminal ends of each groove. In the firmly engaged condition, the firm engagement projections in the grooves are respectively engaged with the engagement projections of the guides projections by fully fitting the fuse holder onto the fuse block.

Other objects, features and advantages of the present invention will become apparent from reading the following description which has been made in conjunction with the accompanying drawings.

BRIEF DESCRIPTION OF THE DRAWINGS

The present invention is illustrated in the following drawings in which.

DETAILED DESCRIPTION OF THE PREFERRED EMBODIMENTS

Figure 1:
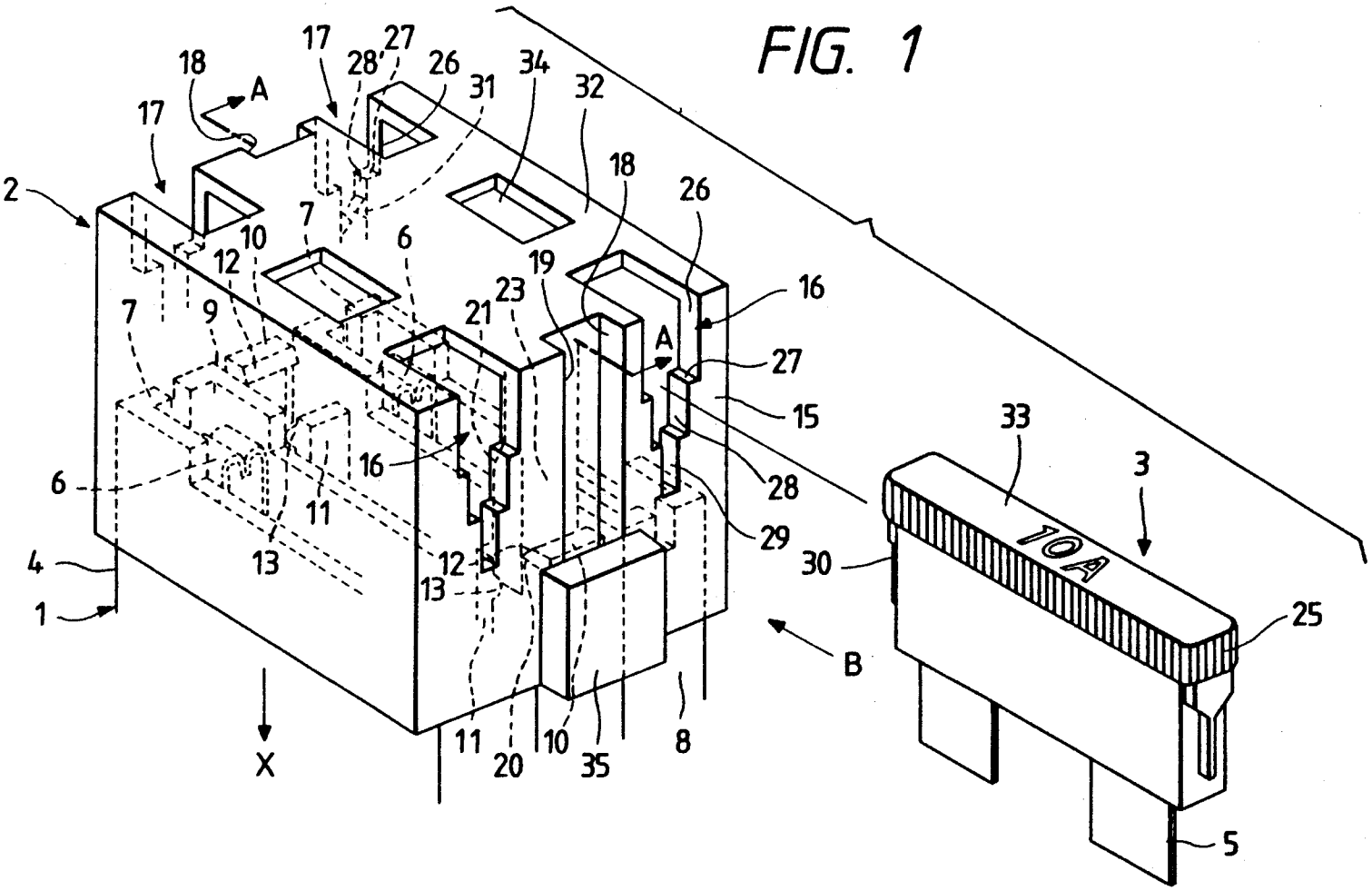
FIG. 1 is a perspective view of a mechanism for electrically connecting and disconnecting dark current fuses in accordance with a first embodiment of the present invention, particularly showing essential components constituting the mechanism in the disassembled state.

The present invention will now be described in detail hereinafter with reference to the accompanying drawings which illustrate preferred embodiments thereof.

First, a mechanism for electrically connecting and disconnecting dark current fuses in accordance with a first embodiment of the present invention will be described below with reference FIGS. 1–3.

In the drawings, reference numeral 1 designates a fuse block for connecting dark current fuses to female type contact members to be described later in an electrical connection box, and reference numeral 2 designates a fuse holder molded of a synthetic resin so as to allow it to be slidably displaced relative to the fuse block 1 in the vertical direction, i.e., in the connecting direction relative to the dark current fuses 3, as indicated by arrow X in FIG. 1.

The fuse block 1 is constructed such that a pair of female type contact members 6 (only one of which is shown in FIG. 1) for receiving tab terminals 5 of a dark current fuse 3 are arranged in a rectangular column-shaped bock housing 4 molded of a synthetic resin. The block housing 4 includes a pair of receiving portions 7 upper ends of which are open for allowing the female type contact members 6 to be brought into engagement with the tab terminals 5. In addition, the block housing 4 includes a pair of provisional engagement pieces 10 provided on the opposite side walls 8, and a pair of firm engagement pieces 11 extending upward at positions respectively below the provisional engagement pieces 10 in the block housing 4, as best illustrated in FIG. 2.

In practice, two dark current fuses are used but for the purpose of simplification, the essential components constituting the mechanism will be described below only with respect to one of the dark current fuses, i.e., the right-hand dark current fuse as seen in FIG. 1.

A provisional engagement pawl 12 projects inwardly from the foremost end of each provisional engagement piece 10 of the fuse holder 2, while a firm engagement projection 13 having a substantially semispherical shape projects outwardly from the foremost end of each firm engagement piece of the fuse block 1. The provisional engagement piece 10 and the firm engagement piece 11 can deflect toward each other.

On the other hand, the fuse holder 2, adapted to slidably receive the fuse block 1, is molded of a synthetic resin in a box-shaped configuration of which the lower end is open. Two pairs of fuse insert guide slots 16 and 17 are respectively formed in opposite side walls 15 of the fuse holder 2 in a side-by-side relationship so as to enable the dark current fuse 3 to be inserted therethrough in the transverse direction, i.e., in the direction indicated by arrow X as seen in FIGS. 1–3. Vertically extending grooves 18 are respectively formed between the guide slots 16 and 17. In addition, an engagement pawl 20, adapted to be engaged with the provisional engagement pawl 12 discussed above, is formed so as to extend outwardly from groove wall 19 which partially defines the vertically extending groove 18. Further, an engagement portion 21, adapted to be engaged with the firm engagement projection 13, is formed on the inside portion of the groove wall 19 at the upper part thereof, and an engagement corner 22, adapted to abut against the firm engagement projection 13, is formed at the lower, inside end of the groove wall 19. Thus, an engagement wall portion 23 includes the engagement pawl 20, the engagement portion 21 and the engagement corner 22.

Each of the guide slots 16 and 17 includes an insert slot 26 for receiving a fuse head 25, stepped portions 27 for holding the fuse head 25, an insert slot 28 for receiving a main body of the dark current fuse 3 and a tab insert slot 29 for receiving the tab terminals 5. The insert slot 26, the stepped parts 27, the insert slot 28 and the tab insert slot 29 are formed in the stated order as viewed from above corresponding to the sectional contour of the dark current fuse 3 so as to hold the latter from the opposite sides. In addition, each guide slot 17 on the insert terminal end side includes an insert slot 28' for receiving the main body of the dark current fuse 3, and a pair of projections 31 are formed so as to project toward the insert slot 28' so as to enable a rib 30 on the dark current fuse 3 to be clamped by the projections 31.

Display windows 34 are formed on an upper wall 32 of the fuse holder 2 so as to allow a mark 33 on the fuse head 25 of the dark current fuse 3 to be visually recognized therethrough by a user. Additionally, a pair of expanded protective walls 35 are formed integral with the side walls 15 at the lower part of the dark current fuse 3 when the fuse is located opposite to the engagement pieces 10.

Figure 2:
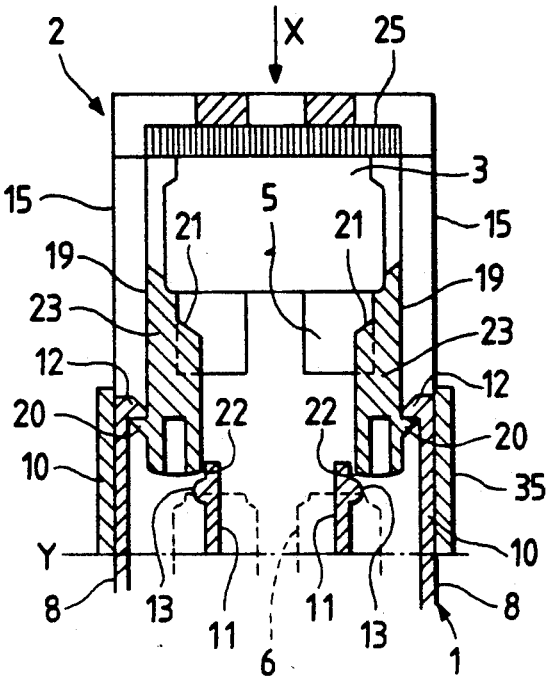
FIG. 2 is a sectional view of the mechanism taken along line A—A in FIG. 1, particularly showing a fuse holder in a provisional engagement condition while the dark current fuses are held in the electrically disconnected state.
Figure 3:
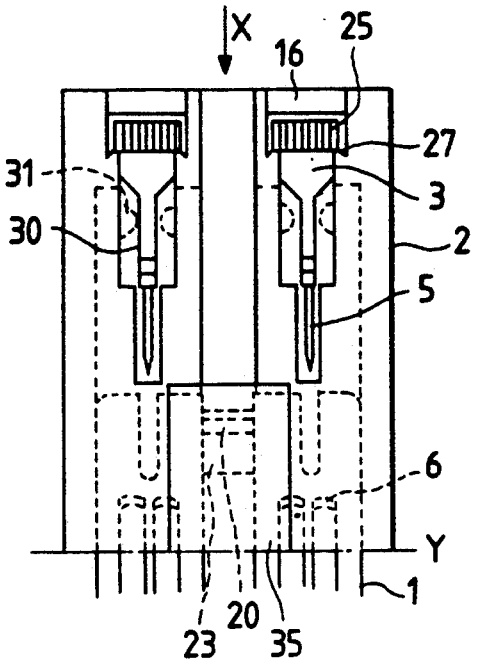
FIG. 3 is a side view of the mechanism as viewed from the direction of arrow B in FIG. 1.

Referring to FIG. 2, the fuse holder 2 is held in the provisionally engaged state with the engagement corners 22 of the engagement wall portions 2 located adjacent the firm engagement projections 13 and the engagement pawls 20 located adjacent the provisional engagement pawls 12.

Figure 4:
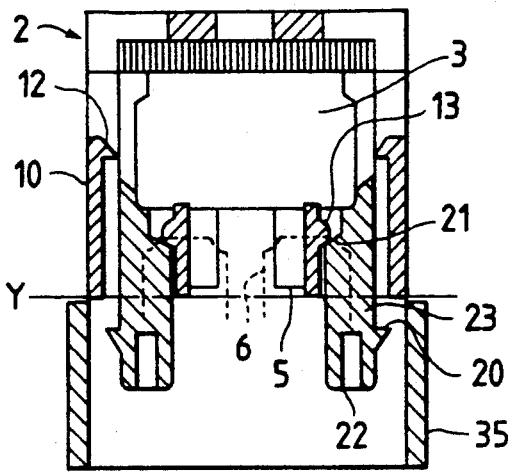
FIG. 4 is a sectional view of the mechanism, particularly showing the fuse holders in a firm engagement condition when the dark current fuse is held in the electrically connected state.
Figure 5:
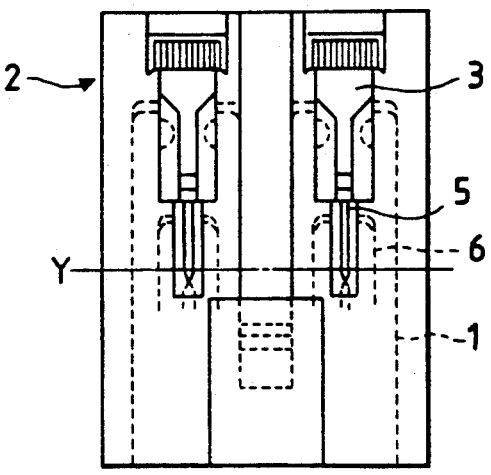
FIG. 5 is a side view of the mechanism, particularly showing the fuse holder in the firm engagement condition.

When the dark current fuse 3 is urged in the downward direction (as indicated by arrow X) from the foregoing provisionally engaged state with an operator's hand, the engagement wall portions 23 are downwardly displaced while deflecting the firm engagement pieces 11 inwardly, whereby the engagement portions 21 become engaged with the firm engagement projections 13, and simultaneously, the tab terminals 5 of the dark current fuse 3 electrically contact the female type contact members 6 on the fuse block I side, as shown in FIGS. 4 and 5. For the purpose of convenience, a reference position for the fuse holder 2 is represented by a dot-dash chain line Y in FIG. 5.

When the dark current fuse 3 is to be released from the firmly engaged state illustrated in FIGS. 4 and 5, the fuse holder 2 is forcibly displaced in the upward direction with the operator's hand, causing the engagement portions 21 to squeeze the firm engagement projections 13, resulting in the firm engagement pieces 11 being deflected inwardly to resume the electrically disconnected state (provisionally engaged state) as shown in FIG. 2.

Figure 6:
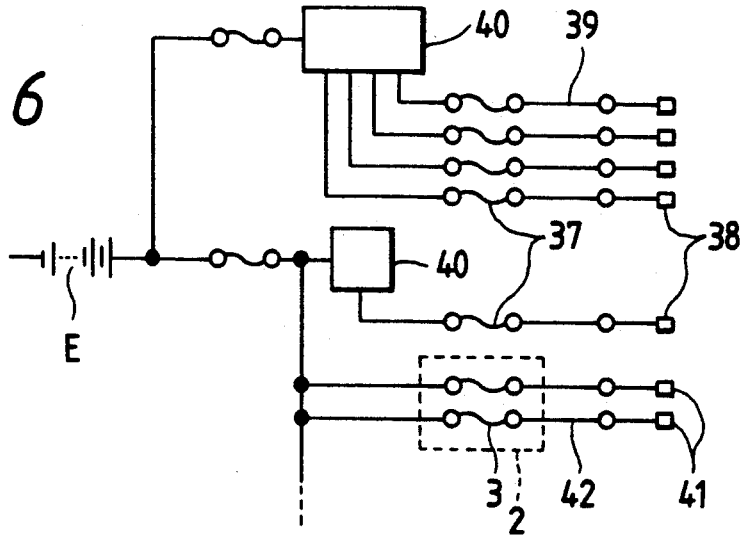
FIG. 6 is a circuit diagram illustrating circuits of a vehicle for which the mechanism of the present invention is employed.

FIG. 6 is a circuit diagram which illustrates the arrangement of circuits for a vehicle for which the mechanism for electrically connecting and disconnecting dark current fuses in accordance with the present invention is employed. In the drawing, e reference character E designates a power source (battery), reference numeral 37 designates an ordinary fuse disposed in a circuit 39 connected to various kinds of electrical equipment 38, reference numeral 40 designates a switch disposed in the circuit 39, and reference numeral 3 designates dark current fuses disposed in a dark current circuit 42 electrically connected to a dark current component 41 such as a clock, a lamp or the like. As is apparent from the drawing, the dark current fuses 3 are fitted into the fuse holder 2 in an electrical connection box (not shown) while they are connected directly to the battery E.

Next a mechanism for electrically connecting and disconnecting dark current fuses in accordance with a second embodiment of the present invention will be described below with reference to FIG. 7.

Figure 7:
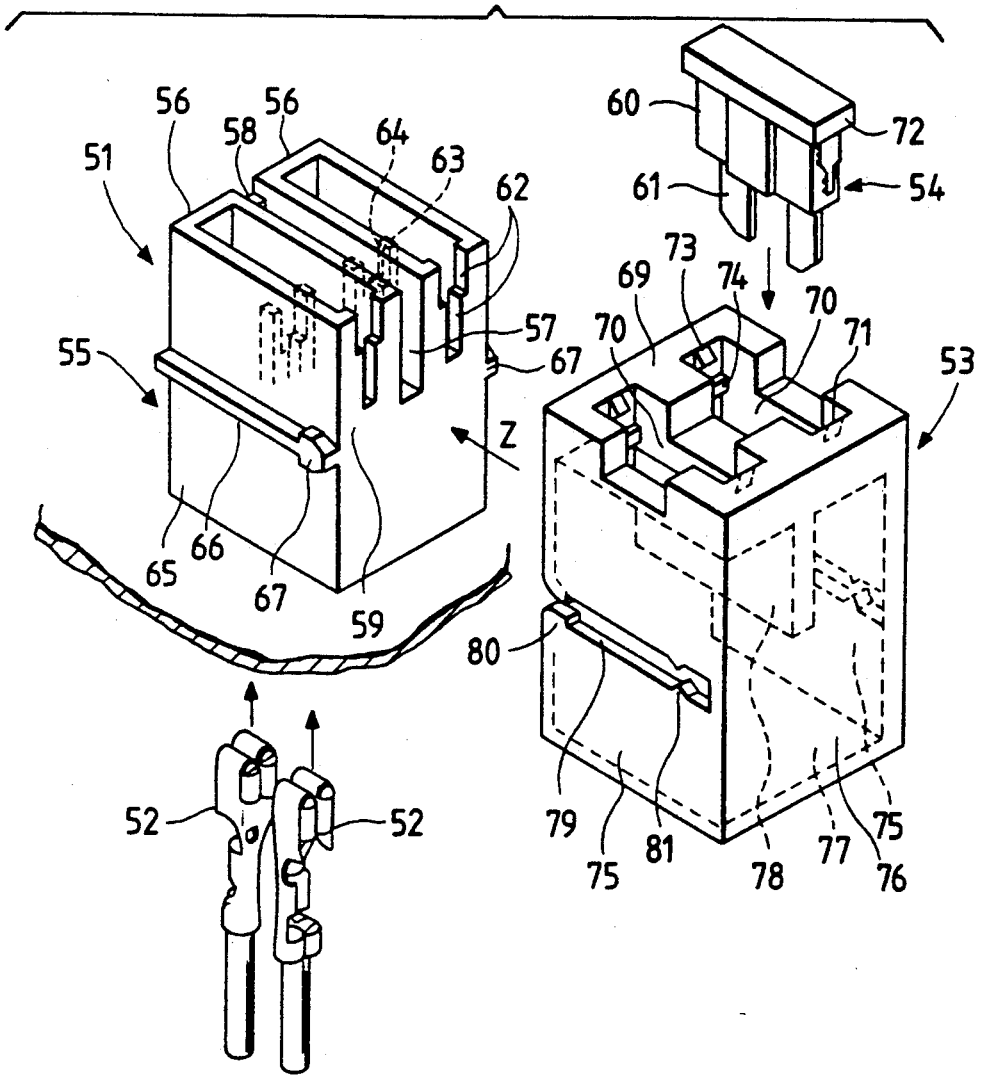
FIG. 7 is a perspective view of a mechanism for electrically connecting and disconnecting dark current fuses in accordance with a second embodiment of the present invention.

In FIG. 7, reference numeral 51 designates a fuse block in which female type contact members 52 are received, and reference numeral 53 designates a fuse holder into which a dark current fuse 54 is inserted from above. As best illustrated in FIG. 7, the fuse holder 53 is engaged with the fuse block 51 by slidably displacing the fuse bock 53 in a transverse direction as indicated by arrow Z.

A main body 55 of the fuse block 51 is constructed to receive a pair of female type contact members 52. The main body 55 includes a pair of vertically extending receiving portions 56 which are open at the top, a guide groove 57 formed between the receiving portions 56, a vertically disposed stopper plate 58 located at the rear end of the guide groove 57, and insert slots 62 formed in a common front wall 59 of the receiving portions 56 so as to allow a main body 60 and tab terminals 61 of each dark current fuse 54 to pass through the insert slots 62. Additionally, a partition plate 64 having an insert groove 63 for receiving the tab terminals 61 is disposed in each receiving portion 56, and guide projections 66 are formed on opposite side walls 65 for the purpose of correctly guiding the slidable displacement of the holder 53 into engagement with the fuse block 51 with the aid of engagement pawls 67 disposed at the foremost end of the guide projections 66.

Fuse insert guide slots 70 are formed in an upper wall of the fuse holder 53, engagement pawls 73 and stopper projections 74 are separately formed on front and rear inner walls 71 of the guide slits 70, and a fuse block engagement space 77, defined by opposite side walls 75 and a front wall 76, is formed below the guide slots 70 so that the tab terminals 61 of the dark current fuse 60 can project into the engagement space 77. In addition, a projection 78 is suspended from the upper wall 69 of the fuse holder 53 so as to be insertable into the guide groove 57 in the main body 55 of the fuse block 51 by slidably displacing the fuse holder in the transverse direction, as indicated by arrow Z. Cutout grooves 79 are formed in the opposite side walls 75 of the fuse holder 53 for receiving the guide projections 66 therein. Provisional engagement projections 80 are formed near the open end of the cutout grooves for engaging the engagement pawls 67 of the guide projections 66 as seen in FIG. 7. Similarly, firm engagement projections 81 are formed near the terminal ends of the cutout grooves 79 for engaging the engagement pawls 67.

Figure 8:
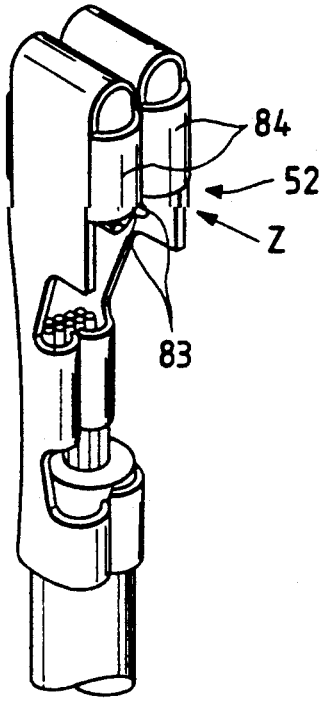
FIG. 8 is an enlarged perspective view of female type contact member.

As shown in FIG. 8 in an enlarged scale, the . female type contact member 52 includes a pair of inverted U-shaped leaf springs 83, and a convexly bent guide piece 84 bridged between the opposite sides of each leaf spring 83. Thus, the tab terminals 61 of the dark current fuse 54 can be inserted between the pair of leaf springs 83 from one side in the Z arrow-marked direction.

Figure 9:
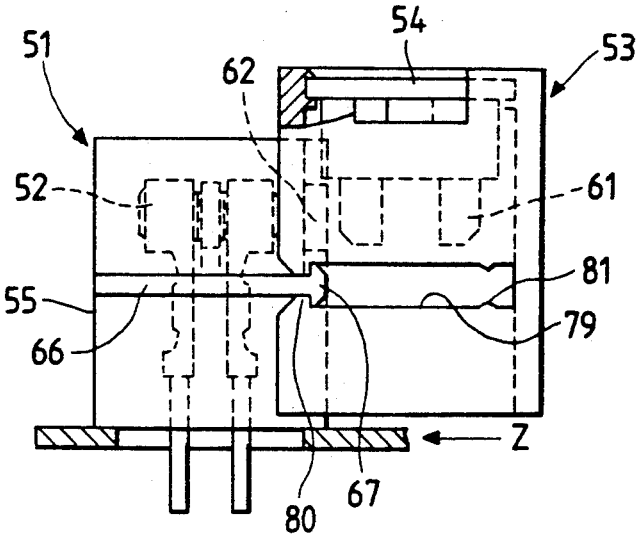
FIG. 9 is a partially exploded front view of the fuse holder, particularly showing the fuse holder in a provisional engagement condition.
Figure 10:
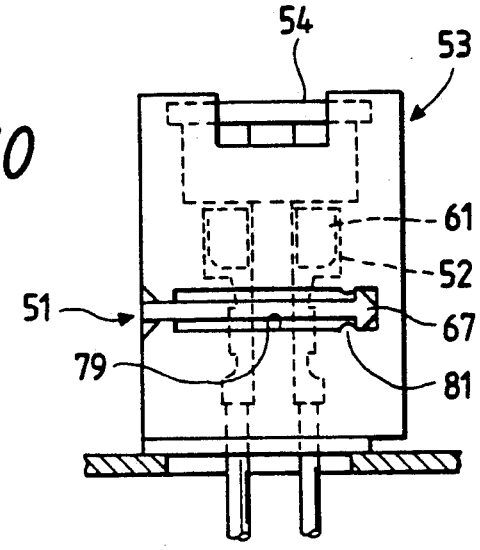
FIG. 10 is a front view of the fuse holder, particularly showing the fuse holder in a firm engagement condition.
Figure 11:
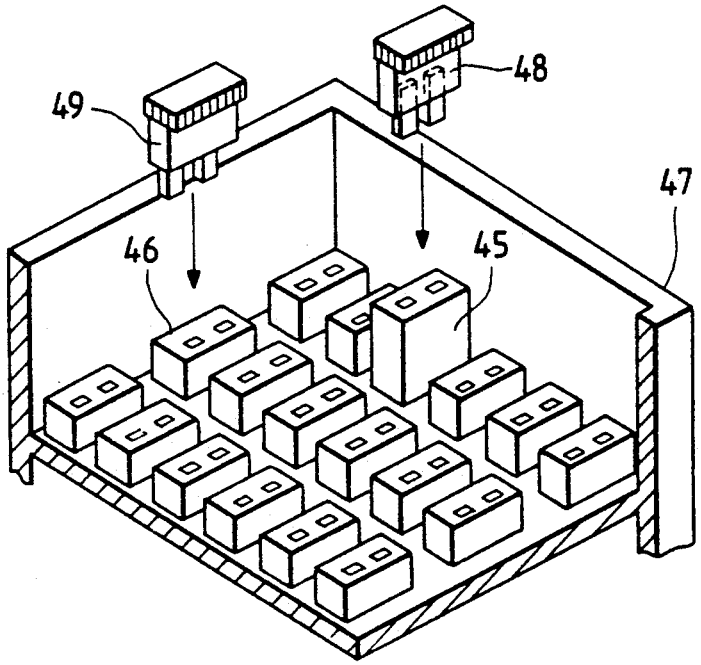
FIG. 11 is a perspective view of a conventional mechanism for electrically connecting and disconnecting dark current fuses.

FIGS. 9 and 10 illustrate the manner in which the fuse holder 53 is slidably engaged with the fuse block 51 after the dark current fuse 54 is fitted into the fuse holder 53.

Referring to FIG. 9, the fuse holder 53 is held by the fuse block 55 in the provisionally fitted state by bringing the engagement pawls 67 of the guide projections 66 into engagement with the provisional engagement projections 80 in the cutout grooves 79.

As the fuse holder 53 is slidably displaced in the transverse direction (the direction of arrow z), the main body 70 and the tab terminals 61 of the dark current fuse 54 pass through the insert groove 62 and engage with the female type contact members 52, as shown in FIG. 10. Simultaneously, the firm engagement projections 81 on the cutout grooves 79 are forced past the engagement pawls 67 of the guide projections 66 to assume the firmly engaged state, i.e., the electrically connected state in cooperation of the fuse holder 53 with the fuse block 51.

When the dark current fuse 54 is to be released from the electrically connected state, the fuse holder 53 is drawn in the reverse direction by an operator's hand to the provisionally engaged state, i.e., the electrically disconnected state as shown in FIG. 9 is resumed.

As is apparent from the above description, according to the present invention, each dark current fuse can be electrically connected to and disconnected from female type contact members on the fuse block side without the necessity of removing the dark current fuses from the fuse holder merely by slidably displacing the fuse holder with the operator's hand. Thus, there is no possibility that dark current fuses will be inadvertently lost. In addition, dark current circuits can easily and reliably be connected and interrupted with the mechanism of the present invention even by any unskilled operator.

While the present invention has been described above merely with respect to two preferred embodiments thereof, it should of course be understood that the present invention should not be limited only to these embodiments but various change or modification may be made without departure from the scope of the present invention as defined by the appended claims.

What is claimed is:

1. A mechanism for electrically connecting and disconnecting dark current fuses to respective contact members, comprising:

a fuse holder having fuse insertion guide slots for receiving said dark current fuses, each of said dark current fuses including a main body and two terminal tabs;

a fuse block slidably movable in an insertion direction with respect to said fuse holder, said fuse block including the contact members adapted to be engaged with said terminal tabs of said dark current fuses by displacing said terminal tabs, in positional alignment with said contact members, in said insertion direction for engagement of said terminal tabs with said contact members;

provisional engaging means for provisionally engaging said fuse holder with said fuse block by slidably fitting a portion of said fuse holder onto said fuse block; and firm engagement means for firmly engaging said fuse holder with said fuse block by slidably moving said fuse holder with respect to said fuse block so that said terminal tabs electrically contact said contact members, wherein said provisional engaging means comprises provisional engagement projections each projecting inwardly from a foremost end of a provisional engaging member of the fuse block and engagement pawls protruding from said fuse holder which are adapted to be respectively engaged with said provisional engagement projections.

2. The mechanism according to claim 1, wherein said provisional engaging means retains said terminal tabs in the electrically disconnected state relative to said contact members without removal of said dark current fuse from said fuse holder.

3. A mechanism for electrically connecting and disconnecting dark current fuses to respective contact members, comprising:

a fuse holder having fuse insertion guide slots for receiving said dark current fuses, each of said dark current fuses including a main body and two terminal tabs;

a fuse block slidably movable in an insertion direction with respect to said fuse holder, said fuse block including the contact members adapted to be engaged with said terminal tabs of said dark current fuses by displacing said terminal tabs, in positional alignment with said contact members, in said insertion direction for engagement of said terminal tabs with said contact members;

provisional engaging means for provisionally engaging said fuse holder with said fuse block by slidably fitting a portion of said fuse holder onto said fuse block; and firm engagement means for firmly engaging said fuse holder with said fuse block by slidably moving said fuse holder with respect to said fuse block so that said terminal tabs electrically contact said contact members, wherein said firm engaging means comprises firm engagement projections each projected outwardly from a foremost end of a firm engaging member of the fuse block and engagement portions provided on engagement wall portions of said fuse holder which are adapted to be respectively engaged with said firm engagement projections.

4. A mechanism for electrically connecting and disconnecting dark current fuses to respective contact members, comprising:

a fuse holder having fuse insertion guide slots for receiving said dark current fuses, each of said dark current fuses including a main body and two terminal tabs;

a fuse block including said contact members extending in a first direction and adapted to be engaged with said terminal tabs of said dark current fuses by displacing said terminal tabs in a second direction transverse to said first direction;

provisional engaging means for provisionally engaging said fuse holder with said fuse block by slidably fitting a portion of said fuse holder onto said fuse block in said second direction; and firm engagement means for firmly engaging said fuse holder with said fuse block by slidably moving said fuse holder with respect to said fuse block in said second direction so that said terminal tabs electrically contact said contact members.

5. The mechanism according to claim 4, wherein said provisional engaging means retains said terminal tabs in an electrically disconnected state relative to said contact members without removal of said dark current fuse from said fuse holder.

6. The mechanism according to claim 5, wherein said provisional engaging means comprises guide projections formed on the opposite side walls of said fuse block and including engagement projections at the foremost ends thereof; and cutout grooves formed in the opposite side walls of said fuse holder for respectively receiving said guide projection and including provisional engagement projections formed on an open, inlet side of said cutout grooves, said provisional engagement projections being respectively engaged with said engagement projections when said fuse holder is held in the provisionally engaged state.

7. The mechanism according to claim 4, wherein said firm engaging means comprises guide projections formed on the opposite side walls of said fuse block and including engagement projections at the foremost ends thereof; and cutout grooves formed on the opposite side walls of said fuse holder for respectively receiving said guide projections and including firm engagement projections formed at a terminal, closed end of said grooves, said firm engagement projections being respectively engaged with said engagement projections when said fuse holder is held in the firmly engaged state.

* * * * *